United States Patent [19]

Meyer

[11] Patent Number: 4,785,538

[45] Date of Patent: Nov. 22, 1988

[54] CUTTING TOOL

[76] Inventor: Fred J. Meyer, 335 W. 75 Place, Hialeah, Fla. 33014

[21] Appl. No.: 73,911

[22] Filed: Jul. 13, 1987

Related U.S. Application Data

[63] Continuation of Ser. No. 15,551, Feb. 13, 1987, abandoned, which is a continuation of Ser. No. 784,138, Oct. 4, 1985, abandoned.

[51] Int. Cl.[4] ..... B26B 13/00

[52] U.S. Cl. ..... 30/258; 30/92; 30/132

[58] Field of Search ..... 30/131, 132, 228, 258, 30/261, 92

[56] References Cited

U.S. PATENT DOCUMENTS 4,336,632 6/1982 Robertson ..... 30/258

4,543,719 10/1985 Pardoe ..... 30/228

FOREIGN PATENT DOCUMENTS 21008 7/1897 United Kingdom ..... 30/261

*Primary Examiner*—Douglas D. Watts

*Attorney, Agent, or Firm*—John Cyril Malloy

[57] ABSTRACT

A cutting tool designed to provide a straight line cut through plastic or like material conduit and incorporating pivoted handles respectively including a cutting blade and a positioning anvil formed at the distal ends thereof and in cooperative relation to one another so that the conduit product positioned in the anvil will be maintained in a cutting position to achieve an accurate straight line cut. A return spring, a stop element and a closed end configuration are provided on the remainder of the handles, substantially adjacent to the proximal ends thereof to prevent nesting engagement of the handles during the cutting operation and maintain predetermined spaced relation between the ends of the handle so as to insure their separation and return to a cutting position once gripping pressure is released.

11 Claims, 2 Drawing Sheets

CUTTING TOOL

BACKGROUND OF THE INVENTION

This is a continuation application of copending application Ser. No. 15,551 filed Feb. 13, 1987, which is a continuing application of application Ser. No. 784,138 filed on Oct. 4, 1985, both now abandoned.

1. Field of the Invention

This invention relates to a cutting tool comprising two pivotally attached handles positionable into a cutting orientation relative to a conduit product being cut and incorporating specific structural features on the individual handles substantially adjacent the proximal ends thereof to prevent nesting of the handles during the cutting operation and maintaining a spaced relation therebetween so as to facilitate return of the handles to a product accepting position.

2. Description of the Prior Art

Hand operated cutting tools designed for the cutting of a wide variety of products have been known and utilized in the prior art for many years. Cutting tools of the category referred to generally include pivotally interconnected handles having a cutting blade secured to a distal end of one of such handles and a positioning or gripping structure secured to the distal end of the other of such handles. Upon gripping pressure, by the hand of the user, being applied to or adjacent the proximal end of the handles, the blade and positioning structure are drawn together and the blade is forced, through lever action, into its cutting position, generally through the product intended to be cut.

Dependent upon the particular structure, product or item intended to be cut, the cutting tools recognized in the prior art include specific structural features in order to facilitate the desired cutting of such individual items.

The following U.S. patents are representative of the various known prior art structures and their individual structural components incorporated to facilitate the cutting of a specific item. The following U.S. patents all relate to cutting instruments: Bender, U.S. Pat. No. 59,168; Drmic, U.S. Pat. No. 2,384,822; Lormeau, U.S. Pat. No. 2,817,255; Olsen, U.S. Pat. No. 2,970,377; Raymond, U.S. Pat. No. 3,259,981; Bianco, U.S. Pat. No. 4,007,523; Sulak, U.S. Pat. No. D. 124,728; Erpenbeck, U.S. Pat. No. D. 243,743; Shaffer, U.S. Pat. No. D. 260,132 and U.S. Pat. No. D. 261,477.

In addition to the above, the U.S. patents to Robertson including utility U.S. Pat. No. 4,336,652 and U.S. Pat. No. Des. 266,736 are also directed to a specifically designed cutting tool for the cutting of flexible plastic conduit. Structural characteristics of the Robertson cutting tool include two handles pivotally interconnected to one another so as to bring a cutting blade into a cutting position relative to product maintained in an anvil. The specific structural characteristics Robertson has included in his tool include a semi-circular concave anvil serving as a positioning structure for the holding of conduits to be cut. The specific semi-circular concave configuration is intended to maintain the conduit in proper cutting position for passage of a cutting blade therethough. Further structural features of Robertson include a total nesting position of the gripping portions of the handle along their entire length as the cutting blade passes entirely through the conduit product to be cut. In order to separate the handles from this nested position, Robertson makes one handle of greater length than the other. While the Robertson cutting tool must be considered operable for its intended function, certain of the structural features on which Robertson specifically relies are of questionable advantage in actual operation. Specifically, the semi-circular concave configuration of the positioning anvil results in a forced "riding-up" of an item, preferably a tubular or cylindrical shaped item, to be cut within the anvil upon the application of the cutting blade thereto. This occurs whenever the tubular item or conduit is of a substantially smaller diameter (size) than that of the semi-circular concave anvil. This in turn could frequently result in a "rythmic" cutting stroke wherein gripping or squeezing pressure applied to the gripping portions of the handle must be applied successively rather than as a clean, one stroke cut. Any type of rythmic or repeated cutting stroke on a single product often results in a nonlinear, jagged, rough or skewed cut. This is totally unacceptable in certain applications where a straight line cut is vital to proper operation or installation of a conduit segment. Such specific applications include drip irrigation and other types of irrigation applications.

In addition to the above, the total nesting feature of the handles along their entire length could also be considered a disadvantage in the Robertson structure since it frequently requires two hands to separate the handles into a product ready position for the next cut. In addition, the fully nested position of the handles results in less cutting pressure that can be applied. The prevention of such full nesting and the maintenance of a space between the handles at the end of the cutting stroke of the knife would permit application of greater pressure and eliminate the need for the tedious separation of the handles with both hands of the user.

SUMMARY OF THE INVENTION

The present invention is directed towards a cutting assembly of the type specifically designed to accomplish a straight line cut through a conduit type product particularly but not necessarily a tubular product formed from plastic or like material capable of being severed. The cutting assembly includes a first and second handle pivotally interconnected to one another. The first handle includes a cutting blade removably secured to the distal end thereof and the second handle includes a positioning anvil integrally formed on the distal end in registry with the cutting blade. The proximal end of each handle is defined by a gripping portion collectively dimensioned to be held and gripped by a single hand of the user. Accordingly, due to the pivotal interconnection of the blade handle and anvil handle, a forcing together of the proximal ends of these handles causes the cutting blade to pass through an elongated slot formed in the positioning anvil and provide a clean, straight line cut through any conduit type object disposed and positioned for cutting within the positioning anvil.

Important features of the present invention serving to distinguish the structure of the subject cutting assembly and make it advantageous over prior art structures include a multi-sided configuration of the positioning anvil and a stop element associated with the larger of the two handles so as to prevent a nesting engagement therebetween when the cutting blade assumes its through cutting position.

The positioning anvil includes a base portion having two upwardly inclined angularly oriented sides meeting at a common junction defining the lowest point of the positioning anvil. Each of the angularly oriented sides are disposed at an incline upwardly to a point of junction between oppositely disposed and spaced apart parallel sides extending upwardly from the base or the distal ends of the inclined sides of the base portion. By virtue of this configuration, an object having a diameter or thickness significantly less than the diameter of the positioning anvil will still have a tendency to be maintained in a "centered" position. The centered position is in overlying relation to the lowest point or common junction between the inclined angularly oriented sides of the base portion of the anvil. Accordingly, the cutting blade may cleanly pass through the object to be cut, in a single stroke since the object to be cut will not have a tendency to "ride up" the walls of the anvil as may be prevelant in certain prior art devices especially when dealing with objects having a tubular shape.

Also, the proximal ends of the blade handle and anvil handle are such as to always maintain a spaced apart relation even as the cutting blade passes through the cutting object to a full cutting position. This allows greater pressure to be exerted on the proximal ends of the handle during the entire cutting stroke and facilitate a one stroke cut or pass of the cutting blade through the object. Other structural features include each extremity of the proximal ends of each handle being closed to totally prohibit a completely nesting orientation of the two handles.

In addition, a return structure in the form of a biasing element is affixed to one of the blades so as to extend outwardly from an inner longitudinal boundary thereof such that the free end of the biasing element abuttingly engages the opposite handle. Due to the inherent bias of this element, the proximal ends of the handles may be forced apart once the gripping pressure is relased by the hand of the user of the assembly. Therefore, the proximal ends of the handles will automatically be forced apart and alleviate the need for separation of the handles using two hands of the user of the subject tool.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
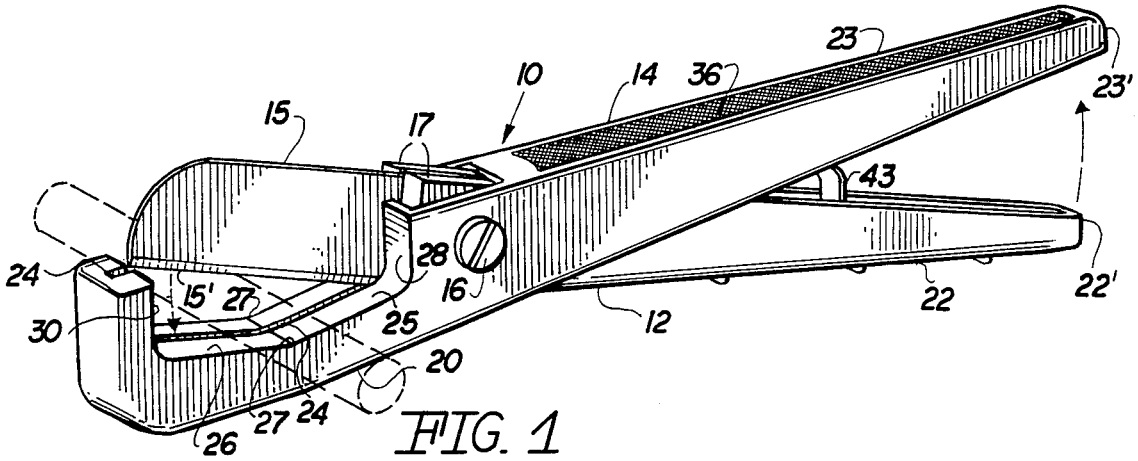
FIG. 1 is a perspective view of the cutting assembly of the present invention.
Figure 2:
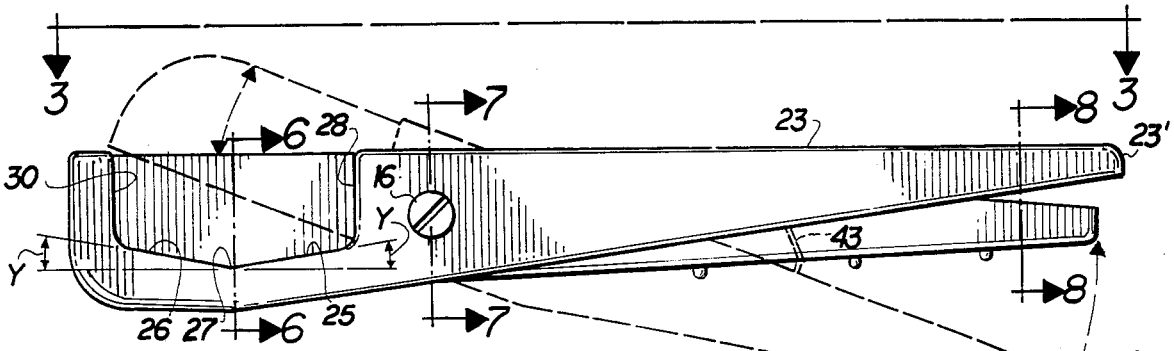
FIG. 2 is a front view of the embodiment of FIG. 1 wherein the blade handle portion of the assembly is shown in broken lines and open position.
Figure 3:
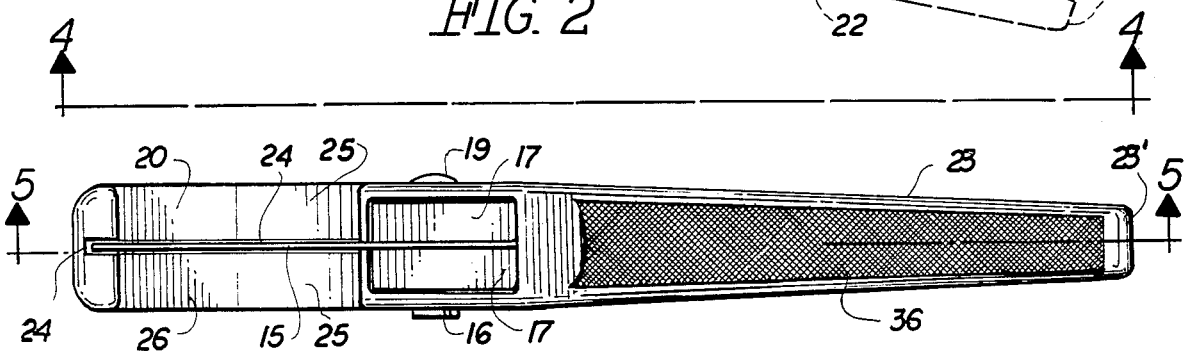
FIG. 3 is a top plan view along line 3—3 of FIG. 2.
Figure 4:
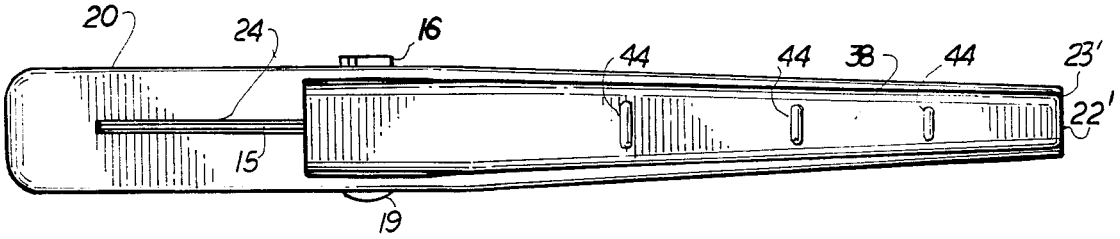
FIG. 4 is a bottom view along line 4—4 of FIG. 2.
Figure 7:
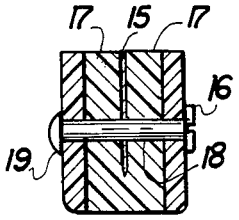
FIG. 7 is a sectional view taken along line 7—7 of FIG. 2.

As shown in FIG. 1, the cutting assembly of the present invention is generally indicated as 10 and includes a first handle 12 and a second handle 14. The first handle 12 has a distal end as at 17 removably secured to a cutting blade 15 with a cutting edge 15'. Accordingly, the first handle 12 comprises a blade handle. Similarly, the second handle 14 has integrally formed at its distal end, a positioning anvil 20. Accordingly, the second handle 14 is herein referred to as the anvil handle. The anvil 20 is specifically configured to include a multi-sided interior surface configuration comprising a base portion defined by two angularly oriented upwardly inclined base sides 25 and 26. The base sides meet at a common junction 27 defining the substantial midpoint of the anvil wherein the common junction 27 also locates the lowest point on the base of the anvil 20. The multi-sided configuaration of the anvil further includes upwardly extending, spaced apart and substantially parallel sides 28 and 30 which have their free end terminate in a mouth which serves as the entrance to the anvil. By virtue of this construction, an object to be cut 50 (see FIG. 5) is centrally located and maintained in a cutting position due to the upwardly angular orientation or incline of the base sides 25 and 26 extending upwardly from the common junction and low point 27 of the anvil. The product 50, which is preferably a conduit having any of the variety of diameters and made of plastic or like material, has a tendency to be centered and maintained in such centered position during the downward cutting stroke of blade 15. As explained in greater detail hereinafter, this provides an advantage over certain prior art structures and allows the user of the cutting tool to have a one stroke clean straight line cut through the object 50. Each of the blade handle and anvil handle 12 and 14 respectively include proximal ends 22 and 23 designed for gripping by a single hand of the user. A pivotal connection by connector 16 serves to force the blade 15 into registry with an elongated linear slot 24 formed centrally along the length of the anvil 20. With reference to FIG. 7, the pivotal connection is defined by connector 16 having an oppositely disposed head 19 and being threadedly interconnected to one another by a pivotal shaft 18. Further, the pivotal shaft 18 passes through an aperture in the blade 15 and thereby removably attaches the blade to the distal end 17 of the blade handle 12 as shown in FIGS. 1 and 7.

Further with regard to FIGS. 1 through 5, the proximal ends 22 and 23 of the blade and anvil handle respectively include a longitudinal exterior boundary portion defined by a closed exterior surface 38 and 36 wherein these closed exterior surfaces lead to respective closed ends 22' and 23' as shown. In addition, the longitudinal configuration of each of the proximal ends 22 and 23 of the blade and anvil handles are further defined by an inner longitudinal boundary 37 and 39 each defined by an at least partially open face extending along a portion of the length thereof.

Figure 5:
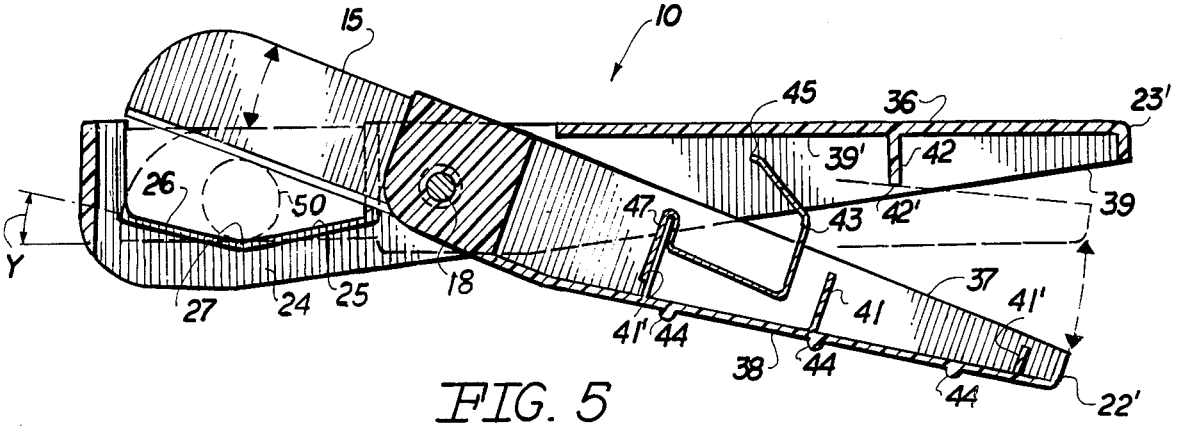
FIG. 5 is a sectional view along line 5—5 of FIG. 3 showing structural features of the cutting assembly of the present invention and their relation to one another.
Figure 6:
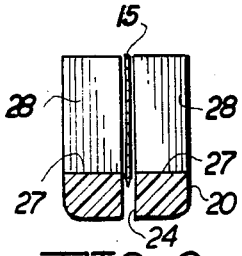
FIG. 6 is a sectional view taken along line 6—6 of FIG. 2.
Figure 8:
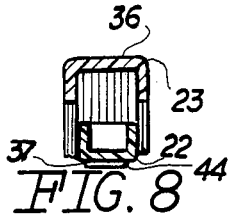
FIG. 8 is a sectional view taken along line 8—8 of FIG. 2.

However, an important feature of the present invention is the provision of a stop element 42 integrally formed to extend outwardly from an inner surface 39' of the proximal end of the handle at least to the inner longitudinal boundary 39 of the anvil handle. This stop element 42 has an outwardly extending edge or peripheral portion 42' which is disposed in direct abutting and interruptive relation to the outer boundary edge of the inner longitudinal boundary as at 37. Accordingly, the handles are specifically prevented from nesting into a closed engagement with one another. This prevention from nesting has the advantage of allowing greater force to be exerted on the object to be cut 50 (see FIG. 5) by a downward single stroke of the cutting blade 15, since a space is maintained between the extremities 22' and 23' of the blade handle and anvil handle respectively. As shown in FIG. 5, the stop element is shown mounted on the anvil handle. However, the configuration of the handles, specifically relating to the thickness (see FIG. 8) may be reversed. In either case, the stop element 42 is positioned on the wider proximal end of the handle structure or the handle structure which has a greater transverse dimension so as to position the outer peripheral extremity 42' into directly abutting engagement with the handle of lesser transverse dimension (see FIG. 8).

Again with reference to FIG. 5, a return means 43 is in the form of a biasing element or spring having a free end 45 disposed in abutting engagement with the inner surface 39' of the anvil handle. The inner end 47 of the biasing element 43, defining the return means, is affixed to an internal rib 41 as at 41'. The overall configuration and dimension of the biasing element 43 is such as to position the free end 45 into abutting engagement with the interior surface 39' of the anvil handle 14.

Other structural features incorporated in the cutting assembly of the present invention is the provision of a plurality of finger grip elements 44 disposed in spaced apart relation to one another along the external surface 38. The finger grips may vary in number but are oriented in transverse relation to the length of the particular handle on which they are mounted as clearly shown.

Figure 9:
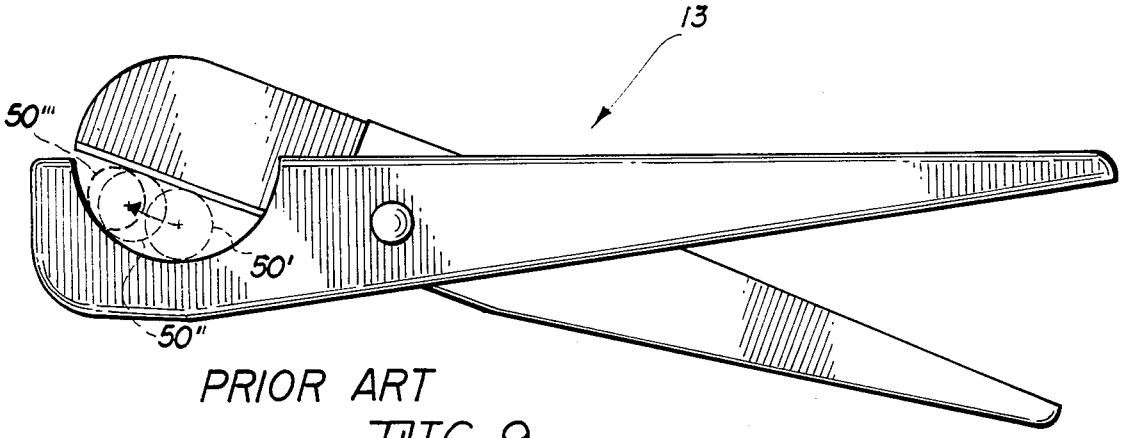
PRIOR ART FIG. 9
FIG. 9 is a front plan view of a prior art cutting tool represented in a cutting position relative to an object to be cut.

With reference to FIG. 9, a prior art structure is generally indicated as 13 wherein an object 50' to be cut is shown disclosed in a concave, semi-circular positioning structure affixed to the distal end of one of the handles. While the structure 13 as shown in FIG. 9 is considered to be operative, certain disadvantages do exist namely relating to the specific curvilinear configuration of the positioning anvil as shown in FIG. 9. With the curvilinear or semi-circular configuration of the anvil, the object 50' especially when having a tubular configuration has a tendency to "ride up" the distant curved wall of the positioning anvil as indicated by the varying positions 50'' and 50''' from the initial position 50' of the object being cut. Such riding up characteristics necessitates an undesirable "rythmic" cutting action which in turn results frequently in a jagged or irregular cutting surface after the cutting blade has passed through the object 50'. This differs from the advantageous single stroke cut of blade 15 (see FIG. 5) as the object to be cut 50 is substantially centered at the common junction 27 defining the low point of the base wherein the base sides 25 and 26 are inclined or oriented in an upwardly angular position. The angle Y may vary but is sufficient to allow and maintain a centered, preferred cutting position of the object 50. Accordingly, while the structure of the present invention will give a single cut stroke resulting in a clean regular cut surface, it is questionable whether the prior art structure of the type shown in FIG. 9 will result in a one stroke clean cut for any diameter object 50' to be cut other than a diameter equal to the diameter of the semi-circular concave anvil configuration. However, the present invention does not depend on the diameter or transverse dimension of the object to be cut 50 being the same a the distance between the parallel sides 28 and 30 of the present invention. As set forth above, the angle Y may vary greatly dependent upon the overall size of the anvil and/or the object to be cut. However, a preferred angle Y or angle of inclination is approximately 30 degrees.

What is claimed is:

1. A hand held cutter assembly primarily designed to provide a straight line cut through a range of varying diameter plastic or like material tubular conduit, said assembly comprising:

a. an anvil handle having an elongated configuration and comprising and orienting anvil secured to a distal end thereof and being configured to transversely receive a conduit having a range of different sizes therein, b. a blade handle having an elongated configuration and pivotally connected to said anvil handle and comprising a cutting blade secured to a distal end thereof in cooperative relation to said anvil, c. said cutting blade having a straight line cutting edge extending along a length thereof and said cutting blade pivotally positionable into and out of cooperative relation to said anvil along a cutting path being substantially perpendicular to the transversely received conduit within said anvil, d. said anvil comprising an orienting means integrally formed thereon for orienting and maintaining the conduit in substantially perpendicular relation to said cutting blade prior to and during a cutting stroke of the cutting blade and passage therethrough, e. said orienting means defined by a structural configuration of said anvil comprising a V-shaped base portion and two spaced apart sides each disposed at an opposite end of said base portion, f. said V-shaped base portion comprising two base sides each extending from a correspondingly positioned one of said two sides at an angular, convergent, straight line orientation to a common junction, g. said common junction disposed at a substantial center of said V-shaped base portion and at a low point thereof, h. said base portion further including a sufficient transverse dimension at said common junction to facilitate said orientation and maintenance of the conduit in substantially perpendicular relation to said cutting blade during the cutting stroke, i. at least one of said handles including a stop element formed thereon in spaced relation to a proximal end of said one handle and disposed to extend into at least contiguous relation to an inner longitudinal boundary of said one handle, and j. said stop element disposed for interruptive engagement with the other of said handles and structured to prevent nesting engagement of said handles into one another when proximal ends thereof are pivoted towards one another.

2. A cutting tool as in claim 1 further comprising a resilient return means mounted on one of said handles for forcing said handles into spaced relation to one another upon a release of gripping pressure from said handles.

3. A cutting tool as in claim 2 wherein said return means comprises a biasing spring mounted on said one handle and dimensioned and configured to extend outwardly from said one handle and beyond an inner boundary thereof into engageable relation with the other of said handles, said biasing spring disposed and structured to bias said handles into spaced relation to one another when engaging both of the handles therebetween.

4. A cutting tool as in claim 3 wherein said biasing spring is mounted on the interior of one of said handles not attached to said stop element, said biasing spring having a substantially U-shaped configuration including a free end thereof projecting outwardly from said inner boundary of said one handle into engageable relation with the opposite of said handles.

5. A cutting tool as in claim 1 wherein said stop element comprises an integrally formed flange mounted on the interior of said anvil handle in transverse relation to a longitudinal axis thereof, said flange being dimensioned to extend outwardly from an interior wall surface to a location at least contiguous to an inner boundary of said anvil handle.

6. A cutting tool as in claim 1 wherein said positioning anvil comprises an elongated slot formed therein and extending along a length thereof in coplanar relation to a central longitudinal axis of said positioning anvil, said slot having a transverse dimension at least minimally greater than that of said blade and disposed to accommodate passing of said blade therethrough.

7. A cutting tool as in claim 6 wherein said slot comprises a uniform linear configuration along its entire length.

8. A cutting tool as in claim 1 wherein said anvil handle and said blade handle each include an outer longitudinal boundary defined by a closed, exterior surface extending along the length thereof and depending side walls disposed in spaced, substantially parallel relation to one another and extending along the length of said respective handle, each of said handles further including an inner longitudinal boundary extending substantially from a point of pivotal interconnection between said handles to said proximal ends of said respective handles.

9. A cutting tool as in claim 8 wherein said return means comprises a biasing spring mounted on said blade handle and dimensioned and configured to extend outwardly from and beyond said inner boundary of said blade handle into engageable relation with said anvil handle, said biasing spring disposed and structured to bias said handles into spaced relation to one another when in engaging relation with said handles and disposed therebetween.

10. A cutting tool as in claim 9 wherein said biasing spring includes a substantially U-shaped configuration including a free end thereof projecting outwardly from said inner boundary of said blade handle into engageable relation with said anvil handle.

11. A cutting tool as in claim 1 wherein at least one of said first and second handles comprises a plurality of finger grip elements secured in spaced relation to one another along the length of the said exterior surface, each of said finger grip elements disposed in transverse orientation to the length of the respective handles.

* * * * *